United States Patent [19]

Moore

[11] Patent Number: 4,627,796

[45] Date of Patent: Dec. 9, 1986

[54] AIR REMOVING APPARATUS

[76] Inventor: Gary R. Moore, 22 Magdalen Crescent, Napier, New Zealand

[21] Appl. No.: 657,263

[22] Filed: Oct. 3, 1984

[30] Foreign Application Priority Data

Nov. 16, 1983 [NZ] New Zealand ..... 206298
Dec. 10, 1983 [NZ] New Zealand ..... 205936

[51] Int. Cl.[4] ..... A47C 31/00; F04B 39/12; F04B 21/04

[52] U.S. Cl. ..... 417/313; 417/550; 5/451

[58] Field of Search ..... 417/437, 550, 313; 5/451–453

[56] References Cited

U.S. PATENT DOCUMENTS

| | | | |
|---|---|---|---|
| 2,573,375 | 10/1951 | Cuinstead | 417/236 |
| 3,797,538 | 3/1974 | Mollura | 5/451 |
| 3,952,348 | 4/1976 | Benjamin | 5/451 |
| 4,073,019 | 2/1978 | Fraser | 5/451 |

FOREIGN PATENT DOCUMENTS

| | | | |
|---|---|---|---|
| 2294344 | 7/1976 | Fed. Rep. of Germany | 5/454 |
| 3020534 | 12/1981 | Fed. Rep. of Germany | 417/550 |
| 1341558 | 12/1973 | United Kingdom | 417/550 |

OTHER PUBLICATIONS

Waterworth Publication entitled Simple Escape, May 7, 1984.

*Primary Examiner*—William L. Freeh
*Attorney, Agent, or Firm*—Holman & Stern

[57] ABSTRACT

Apparatus suitable for employment in the burping of a water bed comprises a screw thread or bayonet in the burping and/or filling opening of a waterbed having a removable cap, and air withdrawal means capable of withdrawing air and/or liquid from the waterbed having a cooperating element engageable with the fitting.

The method of burping a waterbed comprises removing the cap of the fitting in the filling apparatus of a waterbed without substantial loss of liquid therefrom, attaching an air withdrawal device to the fitting about the opening from which the cap has been removed, actuating the air withdrawal device to withdraw air from the bed (with or without lifting of the region of the bag about the fitting to which the apparatus has been attached) and, detaching the air withdrawal device from the fitting when the fitting is positioned so as to minimize the risk of entry of air into the bag and, thereafter refitting the cap to the fitting.

2 Claims, 10 Drawing Figures

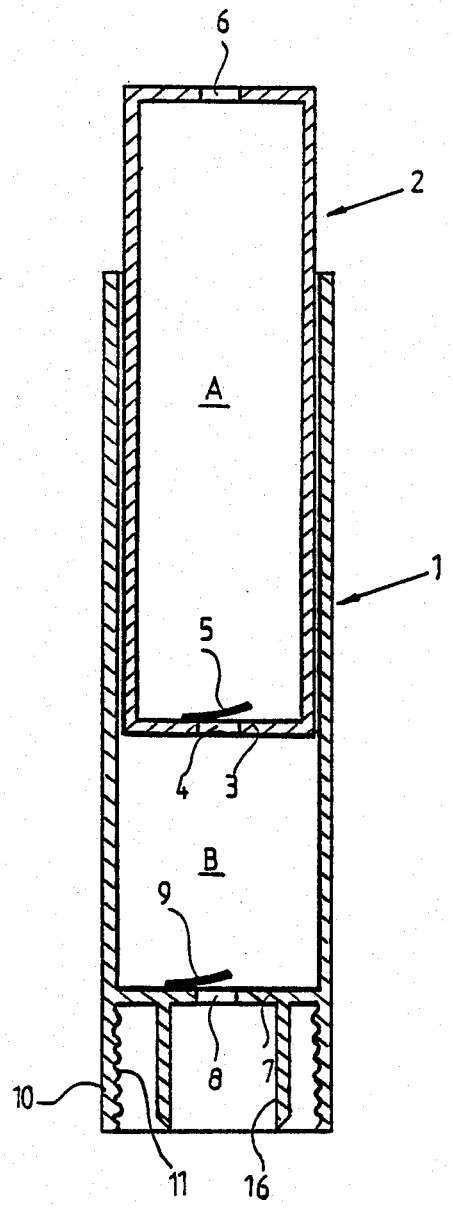
FIG 4
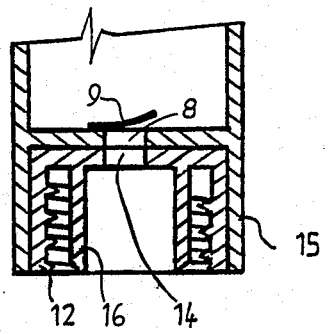
FIG 6
FIG 5
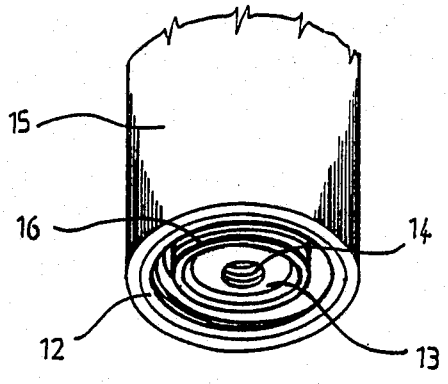

AIR REMOVING APPARATUS

BACKGROUND OF THE INVENTION

1. Field of the Invention

The present invention relates to improvements in and/or relating to means for removing air from a vessel and in particular, although not solely, to means and methods for "burping" a waterbed.

2. Description of the Prior Art

With the advent of waterbeds there has been an awareness of the need to periodically "burp" the waterbed so as to remove air bubbles therefrom which would otherwise float around on the surface of the water or other liquid within the bag of the waterbed thus giving rise to noise which can be distracting and in some cases even to some measure of discomfort. Traditionally the burping has taken the form of rolling some member along the length of a bed so as to coax air bubbles to a "burping" opening from which a screw cap can normally be removed for the purpose. Almost invariably there is a loss of some liquid which gives rise to the need for mopping up.

BRIEF SUMMARY OF THE INVENTION

It is therefore with such difficulties in mind that it is envisaged that a better way can be evolved for the burping of a waterbed.

Accordingly in one aspect the present invention consists in apparatus suitable for employment in the burping of a water bed comprising, means engageable in a screw (or even bayonet or other method) fit arrangement in a fluid tight manner with the burping and/or filling opening of a waterbed after the cap thereof has been removed, and air withdrawal means capable of withdrawing air and/or liquid from within a waterbed via said means engageable with said opening.

Preferably said means engageable in a fluid tight manner with the burping and/or filling opening of a waterbed after the cap thereof has been removed includes a spigot member which will pass at least partially into the opening.

Preferably the engagement is a screw thread engagement and disposed about the spigot but spaced by an annulus is a screw thread engageable with such a threaded burping or filling opening.

Preferably the air removable means takes the form of a vacuum pump such as, for example, a kind as disclosed in, for example, New Zealand Patent Specification No. 152864.

Preferably the means for engaging with the waterbed is a sleeve-like member with a screw thread.

Preferably the screw threaded sleeve-like member is provided by fitting a cap like member to a pump such as, for example, as disclosed in New Zealand Patent Specification No. 152864, but providing a communication opening from the top thereof to allow the operation of the pump.

Preferably the cap like member is a member (preferably moulded) which is attachable to the end of a pump as previously set forth but includes a spigot member disposed about the opening to allow the operation of the cap which spigot in use will be disposed inwardly of the threaded member of the waterbed after its cap has been removed and the apparatus in accordance with the present invention has been screw fitted thereto.

Preferably the apparatus is substantially as hereinafter described.

In yet a further aspect the present invention consists in a method of burping a waterbed which comprises, removing the cap of the waterbed without substantial loss of liquid therefrom, attaching apparatus in accordance with the present invention using said means engageable with said opening to the fitting about the opening from which the cap has been removed, pumping with at least one stroke air from the bed (with or without lifting of that region of the bag about the fitting to which the apparatus has been attached) and, detaching the apparatus from the fitting when the fitting is positioned so as to minimize the risk of entry of air into the bag and, thereafter refitting the cap to the fitting.

Preferably the method is performed substantially as hereinafter described.

In yet a further aspect the present invention may broadly be said to consist in a moulded member or other formed member suitable for converting a pump, for example, a pump as disclosed in New Zealand patent specification No. 152864 to provide apparatus in accordance with the present invention.

Preferably the attachment is substantially as hereinafter described preferably with reference to FIG. 7 of the accompanying drawings.

This invention may also broadly be said to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

BRIEF DESCRIPTION OF THE DRAWINGS

One preferred form of the present invention will now be described with reference to the accompanying drawings wherein:

FIG. 4 is a similar view to that of FIG. 1 but showing an embodiment which a spigot member is preferably disposed about the opening of the pump and positioned substantially axially with respect to the threaded surface to be engaged with the waterbed, the spigot preventing the collapse of the filler neck (which is threaded on the waterbed) during the "burping" operation;

FIG. 5 is a perspective view similar to that of FIG. 2 but showing the annular spigot member as shown in FIG. 6;

FIG. 6 is a view similar to FIG. 3 showing the variation where a spigot member has been provided in the cap showing;

DETAILED DESCRIPTION

Figure 1:
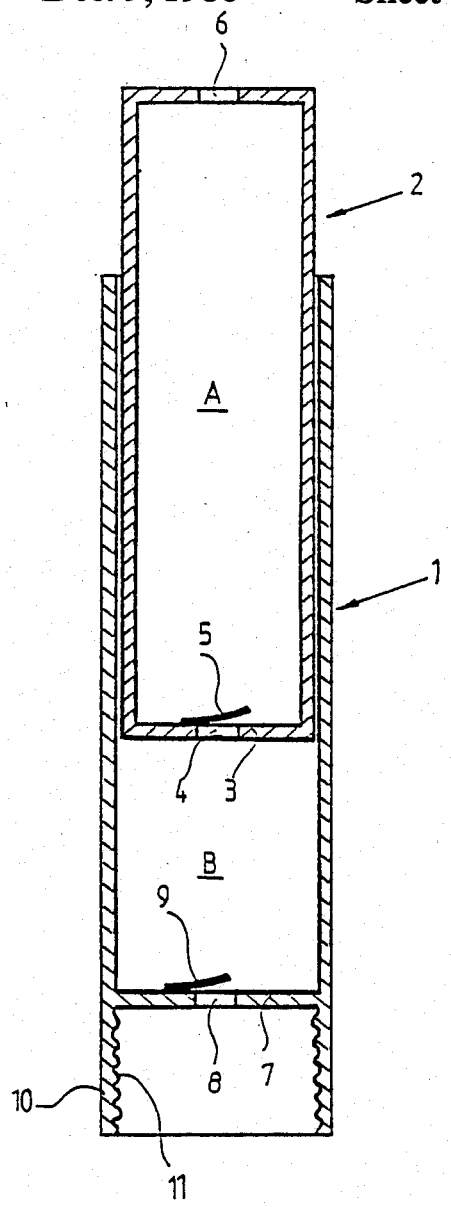
FIG. 1 is a cross sectional view showing one preferred form of the present invention employing a pumping system substantially as disclosed in New Zealand Patent Specification No. 152864 the full disclosure of which is herein corporated by way of reference.

In the preferred form of the present invention the pump operates substantially as diclosed in New Zealand Patent Specification No. 152864. Obviously variations thereof may be employed possibly with a reduced number of membrane valves.

In one preferred form of the present invention however the apparatus comprises essentially two nestible cylindrical members. The first member 1 includes an open end in which the second cylindrical member 2 is receivable. The second cylindrical member 2 includes two end members provided respectively with openings 4 and 6 to allow the movement of air therethrough. The end 3 however is provided with a flap or membrane valve 5 which is biased to a closed condition or is substantially unbiased.

The other cylindrical member 1 includes an end 7 which is provided with an opening 8 which likewise has a flap or membrane valve 9. Both membrane values 5 and 9 are disposed on the same side of the openings 4 and 8 viz. that side which would allow movement of a fluid into the greater bulk of that cylinder (zone B and from thence to zone A) rather than thereform through the opening.

In operation therefore such a pump operates as follows. In use element 2 would be pushed down towards member 7 of the outer cylindrical member 1 such movement of the cylindrical member 2 towards the end region 7, the flap valve 9 would close thereby not passing fluid down through the opening 8. Fluid that does enter into the zone A from the zone B would egress via opening 6.

There would then be a withdrawal of the element 2 to substantially from within the outer cylindrical member 1 which has the effect of closing the flap valve 5 but opening the flap valve 9 which causes the filling of the zone B as it increases with fluid (whether liquid or gaseous) by passage of fluid through the opening 8.

A person skilled in the art will appreciate how the cycle just disclosed can be repeated as necessary to achieve the necessary pumping.

Figure 7:
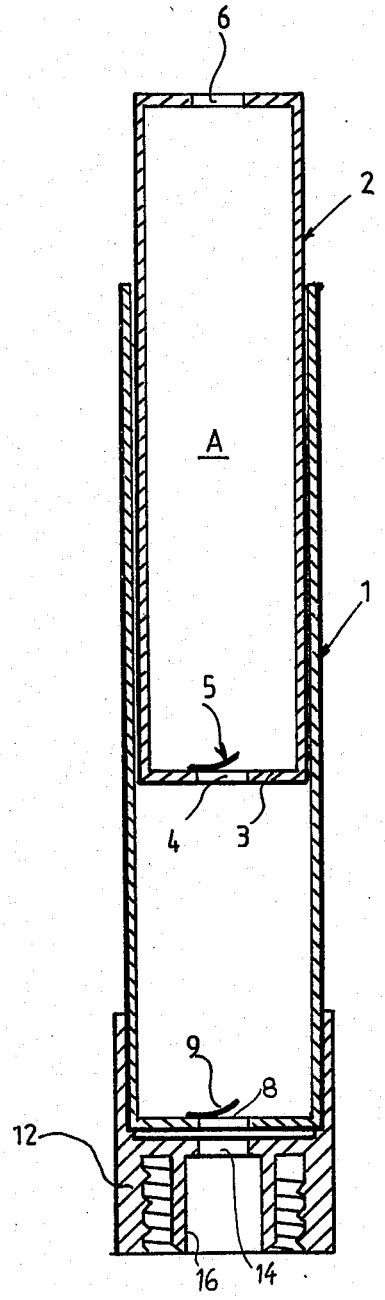
FIG. 7 shows a preferred form of the present invention where a skirted conversion component attachable to a pump, such as; for example disclosed in New Zealand patent specification No. 152864, can be easily adhesively or otherwise attached to the end thereof and can provide all the advantages described above.
Figure 10:
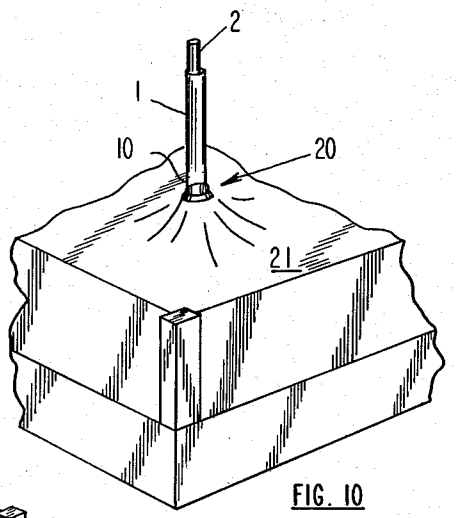
FIG. 10 is a perspective view showing the manner in which the pump apparatus is attached to the fitting shown in FIG. 9 and used by pulling upwardly.
Figure 9:
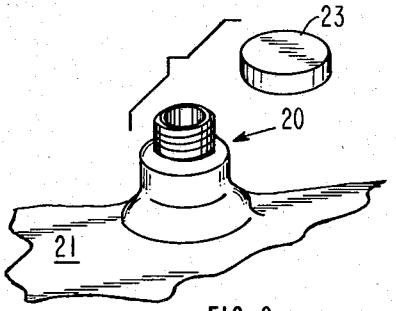
FIG. 9 is an enlarged exploded perspective view of a fitting attached to a filling and/or burping opening in the waterbed.
Figure 8:
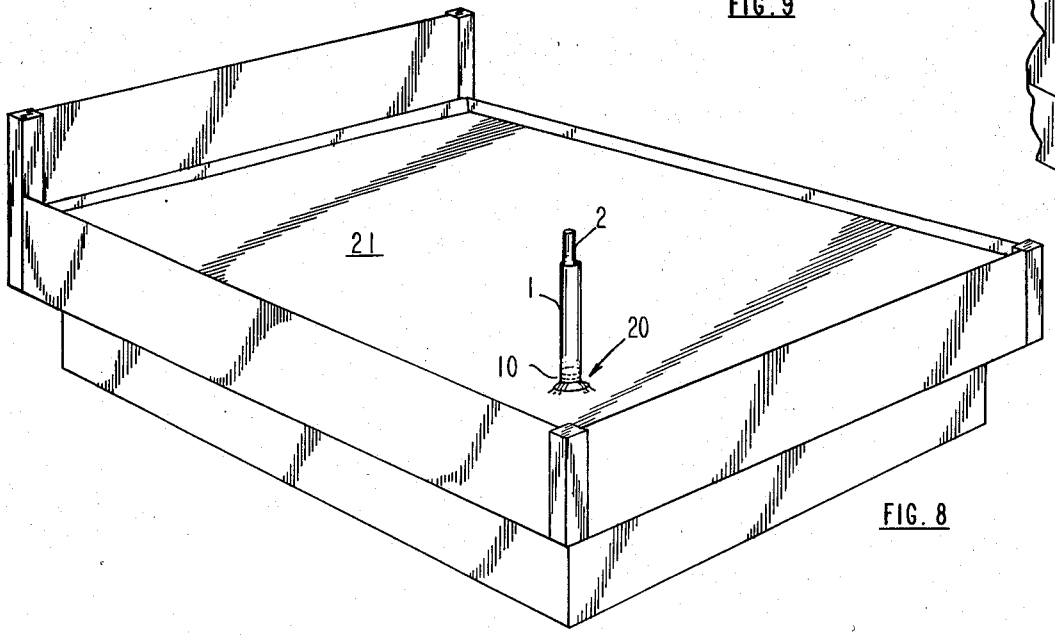
FIG. 8 is a perspective view of a waterbed showing the invention with the pump apparatus attached to the fitting mounted on the waterbed.

In FIG. 1 there is shown disposed on the inside of a cylindrical skirt 10 beyond the end 7 means indicative of a screw thread capable of being engaged on a screw threaded fitting or ferrule 20, each as shown in FIGS. 7, 8 and 9, for example, of a waterbed 21 which surrounds the burping or filling opening and to which a cap 23 is normally attached.

It is possible to modify existing pumps of a kind substantially as disclosed in New Zealand Patent Specification No. 152864 by fitting within the skirt 10 or 15 a screw cap 12 which can be fixed by an appropriate adhesive to the inner side of the skirt or to the end 7. It is necessary however to provide a port or opening 14 which communicates with the opening 8.

Where a waterbed is provided with a flimsy threaded spigot 20 to which the normal closure cap 23 is fitted difficulties can arise owing to the collapse of the filler neck or the threaded spigot during the pumping operation, thus allowing the leakage of air back into the waterbed. With a view to preventing this it is desirable to provide a spigot or annular member which protrudes inwardly of such a filler neck and prevents such collapse. Such an annular member has been shown in FIGS. 4 to 7 inclusive and is identified in FIGS. 4 and 5 by reference numeral 16.

The preferred means for converting a pump such as, for example, disclosed in New Zealand patent specification No. 152864 is as depicted in section in FIG. 7. It can be seen that the attachment includes not only the preferred threaded engagement portion, the preferred annular spigot to prevent collapse of the filler neck and the opening to allow operation of the pump, but also an annular skirt capable of being fixed or press fitted on to the end of the pump as shown. The present invention therefore also consists in such an attachment for a pump and to its use in converting a pump and pump thus converted.

Figure 3:
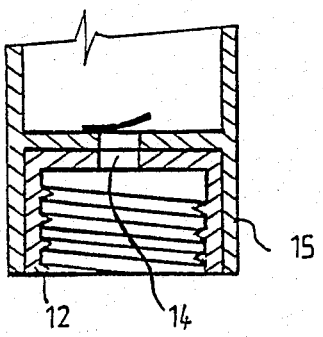
FIG. 3 is a part cross sectional view similar to FIG. 1, but of the end region in a version of the pump apparatus as depicted in FIG. 2.
Figure 2:
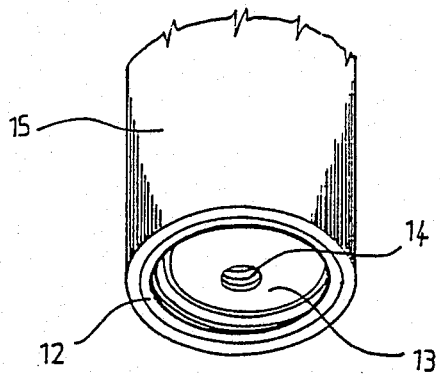
FIG. 2 is a perspective view of the end of the apparatus suitable for attachment to the fitting of a waterbed from which a screw cap has been detached.

The present invention therefore consists in an method of modification of an existing vacuum pump to provide apparatus in accordance with the present invention. Preferably the modification is as shown in FIGS. 2 and 3.

It can be seen therefore that when a bed is to be burped the capped ferrule of the bed can be depressed so that opening of the cap 23 will not lead to a great ingress of air into the waterbed bag, the thread of the cap member 12 or the thread 11 can be engaged therewith whereupon the pumping out of air can take place. Ideally the pump would be lifted up as shown in FIG. 9 so as to distort the bag to which air to be burped therefrom will preferentially migrate. Once pumping has minimized the gaseous content of the bag, possibly even by drawing liquid into zone B, the bag can be returned to a position from which it is safe to disengage the apparatus in the sense that liquid loss is substantially minimized but at the same time it is not possible for air to enter into the waterbed bag via the ferrule. The cap can then be attached and the bed returned to use.

It is believed therefore that the means and methods of the present invention will find widespread acceptance.

What is claimed is:

1. Apparatus for burping a waterbed having a filling and burping opening with a fitting therein for a removable cap for sealingly closing the opening, comprising:

an externally screw-threaded tubular shaped fitting connected with the opening;

a tubular hand operated vacuum pump having an inlet port at one end and an outlet at the other end for extracting air and/or liquid; and a separate cap member attachable to said one end of said pump and sealingly engageable with said fitting comprising a base portion adjacent said one end of said pump, a hole through said base portion aligned with said inlet port, inner and outer substantially coaxial spaced sleeve elements to provide an annulus therebetween, and an internal screw-thread on the inner surface of said outer sleeve element cooperatively and removably engageable with the external screw-thread on said fitting with the inner sleeve member inserted into said fitting, so that the fitting is supported in said annulus and said inlet port communicates with said filling and burping opening when said vacuum pump is attached to the fitting and operation of said vacuum pump will extract air and/or liquid through the opening.

2. Apparatus as claimed in claim 1 and further comprising, a mounting sleeve on said cap member extending coaxially oppositely with respect to said inner and outer sleeve elements and adapted to receive in attaching engagement the inlet port end of the tubular vacuum pump.

* * * * *